United States Patent [19]

Blake et al.

[11] Patent Number: 4,896,618

[45] Date of Patent: Jan. 30, 1990

[54] HANDLING OF LIMP FABRIC

[75] Inventors: Robert C. Blake, Horsham; Shane A. Bone, Chirnside Park; David Lau, Templestowe, all of Australia; Yoshinobu Fukuyama, Yamatotakada, Japan; Hiroji Maegawa, Kashihara, Japan; Hisayoshi Morimoto, Kashikara, Japan; Hiroshi Ogita, Nara, Japan

[73] Assignee: Pacific Dunlop Limited, Australia

[21] Appl. No.: 271,860

[22] PCT Filed: Dec. 30, 1987

[86] PCT No.: PCT/AU87/00447

§ 371 Date: Aug. 29, 1988

§ 102(e) Date: Aug. 29, 1988

[87] PCT Pub. No.: WO88/05021

PCT Pub. Date: Jul. 14, 1988

[30] Foreign Application Priority Data

Dec. 30, 1986 [AU] Australia ..... PH09700

[51] Int. Cl.[4] ..... D05B 35/00; D05B 27/00

[52] U.S. Cl. ..... 112/262.3; 112/121.15; 112/121.26; 112/147; 112/305; 112/DIG. 2

[58] Field of Search ..... 112/303, 305, 121.26, 112/121.27, 121.15, 147, DIG. 2, 287, 121.12, 262.3, 262.1; 223/61; 38/102

[56] References Cited

U.S. PATENT DOCUMENTS

| | | | |
|---|---|---|---|
| 4,463,697 | 8/1984 | Vogt et al. | 112/147 X |
| 4,512,269 | 4/1985 | Bowditch | 112/147 X |
| 4,530,295 | 7/1985 | Adamski et al. | 112/147 X |
| 4,548,141 | 10/1985 | Freermann | 112/147 X |
| 4,624,200 | 11/1986 | Fisher | 112/DIG. 2 X |
| 4,686,916 | 8/1987 | Mathias | 112/121.12 |
| 4,719,863 | 1/1988 | Bisson | 112/121.15 X |
| 4,811,671 | 3/1989 | Hancock | 112/121.26 |

FOREIGN PATENT DOCUMENTS

| | | |
|---|---|---|
| 0044383 | 1/1982 | European Pat. Off. . |
| 2117810 | 10/1983 | United Kingdom . |

*Primary Examiner*—H. Hampton Hunter
*Attorney, Agent, or Firm*—Fred Philpitt

[57] ABSTRACT

Apparatus for stretching and folding a limp fabric piece (1), having a plurality of opposed elastic bands (12,12',13,13') extending therefrom comprising a platform (2) having a foldable segment, means for folding said foldable segment relative to the platform (2), A limp fabric piece feeding plate (5) for feeding said limp fabric piece (1) to said platform (2) and holding said fabric piece (1) thereon in an extended condition and in a pre-determined position to enable eventual folding of the fabric piece (1) to produce a garment, means for moving said plate (5) horizontally or vertically, suction means located adjacent said platform (2) for applying suction to the elastic bands (12,12',13,13') extending from the fabric piece (1), elastic band gripper means associated with the suction means for gripping and holding the sucked-in elastic bands (12,12',13,13'), relative to said suction means, means for moving said suction means relative to said platform (2) to stretch said fabric piece (1), garment gripper means associated with said foldable segment for gripping and holding the stretched fabric piece (1) at the correct position for folding said fabric piece (1) and garment pressing means associated with said platform (2) for pressing and holding the folded fabric piece (1) adjacent the overlapping elastic bands (12,12',13,13') of said fabric piece (1).

12 Claims, 10 Drawing Sheets

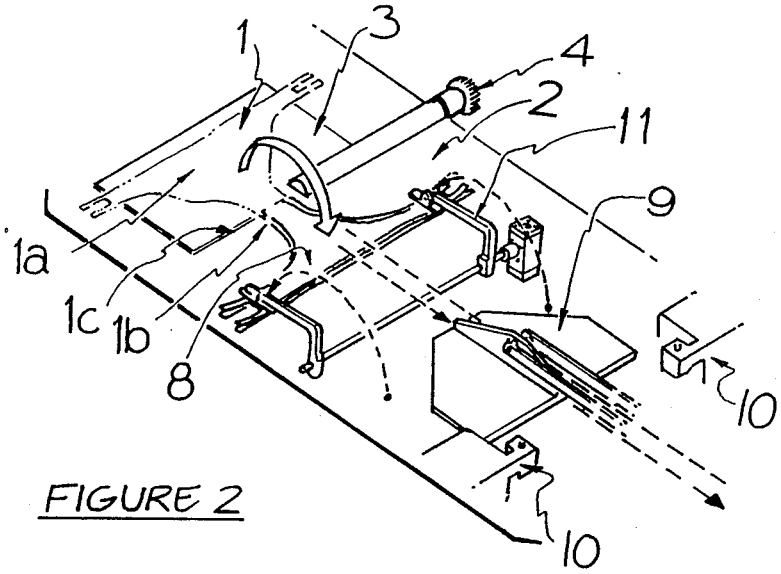
FIGURE 2
FIGURE 7A
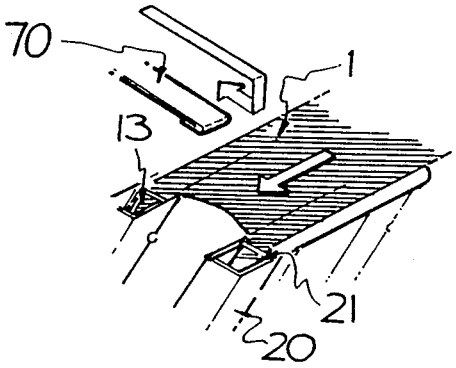
FIGURE 7B
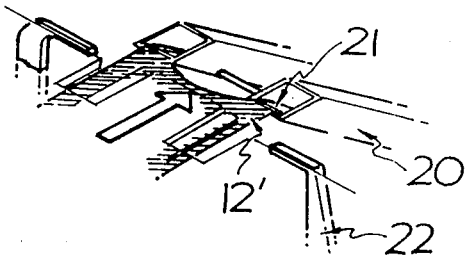
FIGURE 8
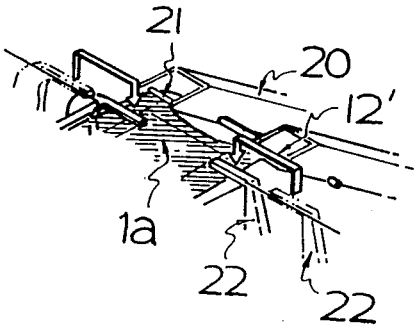

FIGURE 14
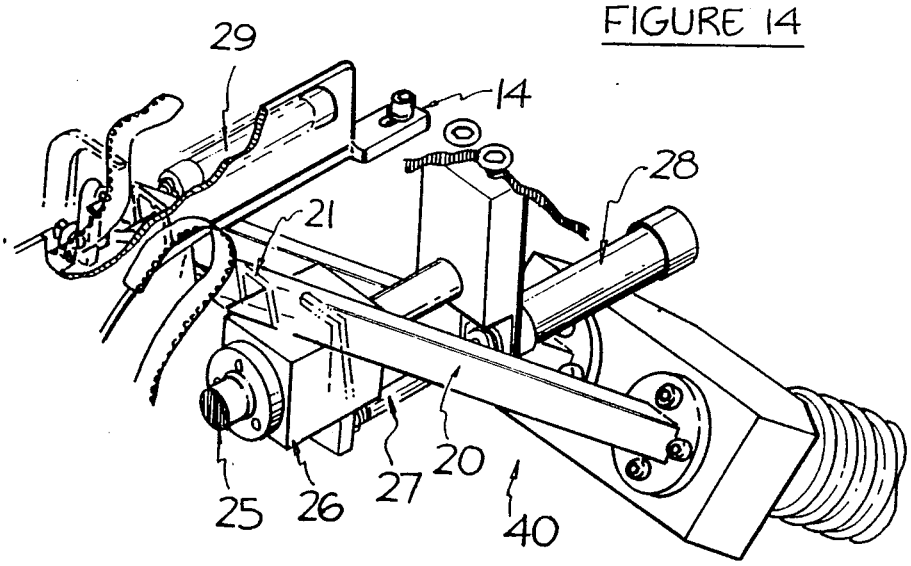
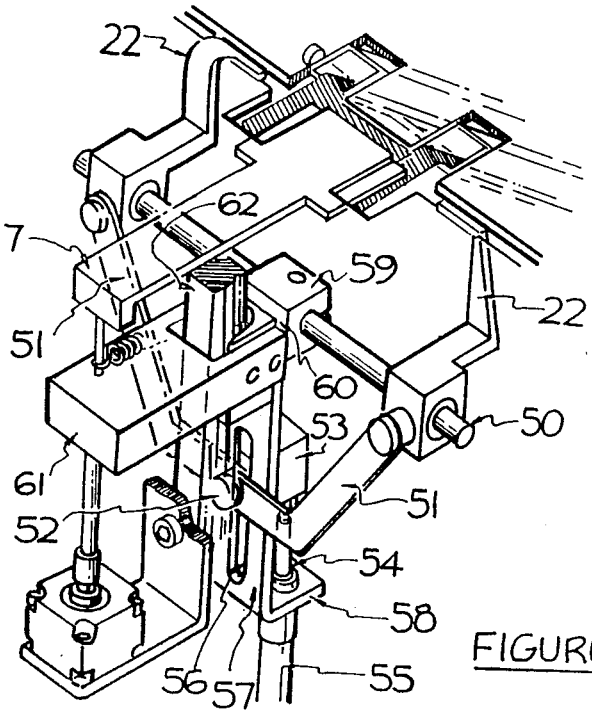
FIGURE. 15

HANDLING OF LIMP FABRIC

This invention relates to the handling of limp fabric in manufacturing processes and in particular, to the stretching and folding of such fabric prior to the performance of a sewing operation thereon.

The fabrication of garments from fabric is currently a labour-intensive process, principally because of the lack of mechanical means for holding pieces of fabric as they are subjected to various operations including transporting, feeding through machines such as sewing machines, and folding.

It is an object of the present invention to provide a method and apparatus for mechanically stretching and folding a limp fabric piece to enable subsequent sewing of the folded fabric piece to produce a garment.

The present invention is an improvement in and modification of the method and apparatus disclosed and claimed in applicant's earlier U.S. Pat. No. 4,811,671, the disclosure of which is hereby imported by reference into the present application.

The invention accordingly provides a method of stretching and folding a limp fabric piece having a plurality of opposed elastic bands extending therefrom comprising locating and holding said fabric piece in an extended condition on a platform having a foldable segment such that one half of said fabric piece is located on said foldable segment and in a position to enable subsequent folding of said fabric piece to obtain the shape of the desired garment, applying suction to said elastic bands in an axial direction thereto by suction means, gripping said elastic bands relative to the suction means, releasing the holding action on said fabric piece, releasing the suction, stretching said fabric piece by axially moving the suction means with the gripped (attached) elastic bands away from said fabric piece, gripping the fabric piece adjacent the elastic bands, associated with said foldable segment, relative to the segment in the correct position to form the garment with overlapping elastic bands when folded, releasing the gripping hold on said elastic bands associated with said foldable segment, folding said segment to form said garment with said elastic bands overlapping, pressing and holding said garment adjacent said overlapping elastic bands, releasing the grip on the elastic bands associated with said (stationary) platform and said foldable segment respectively, and returning said foldable segment.

The garment may then be held flat on said (stationary) platform between said overlapping bands and moved along an adjacent platform to a sewing station after releasing the hold on said garment adjacent said overlapping elastic bands.

The invention also provides apparatus for carrying out the above method, comprising a platform having a foldable segment, means for folding said foldable segment relative to the platform, a limp fabric piece feeding plate for feeding said limp fabric piece to said platform and holding said fabric piece thereon in an extended condition and in a pre-determined position to enable eventual folding of the fabric piece to produce a garment, means for moving said plate member horizontally or vertically, suction means located adjacent said platform for applying suction to the elastic bands extending from the fabric piece, elastic band gripper means associated with the suction means for gripping and holding the sucked-in elastic bands, relative to said suction means, means for moving said suction means relative to said platform to stretch said fabric piece, garment gripper means associated with said foldable segment for gripping and holding the stretched fabric piece at the correct position for folding said piece and garment pressing means associated with said (stationary) platform for pressing and holding the folded garment adjacent the overlapping elastic bands of said fabric piece Conveniently, the apparatus also includes a garment feeding plate reciprocating horizontally adapted to be superimposed on the garment between the points of contact of said garment pressing means and moving said garment to a sewing station after release of said garment pressing means.

Conveniently, the suction means comprises a plurality of suction pipes, one adjacent each elastic band, connected to an air-suction source. These air suction pipes are movable relative to said platform by conventional pneumatic means so as to stretch the fabric piece.

Advantageously, the elastic band gripper means may consist of a clip mounted at the outer end of the suction pipes for pivotal movement about said pipes and which clip may be actuated by a link mechanism coupled to conventional pneumatic means.

The garment gripper means may take the form of a pair of horizontally, slidably mounted brackets which are reciprocally movable to opposed positions above the fabric piece adjacent to the elastic bands and are also mounted for vertical movement to achieve gripping and release respectively of the fabric piece relative to the foldable segment. The aforementioned movements of the garment gripper brackets may conveniently be actuated by conventional pneumatic means.

Advantageously, the garment gripper means associated with each leg elastic band is mounted separately to the other (proposed) gripper means (associated with the waist elastic band) and is associated with optical alignment means to ensure alignment of the leg elastic bands to ensure in turn alignment of these after folding for subsequent sewing operation).

The garment pressing means may conveniently consist of a pair of brackets pivotally mounted on a common axle, the brackets being spaced such that contact with the garment is made adjacent but on the outside of the point of contact of the fabric gripper means. Advantageously, these brackets have pivotally mounted at the outer ends thereof, garment contacting platelets for contacting and holding the folded garment against the platform. Rotational movement about the common axle is actuated by conventional electrical means.

Advantageously, additional stretching and aligning means are provided on both sides of the stretched fabric piece principally for the purpose of correctly aligning the two halves of the fabric piece so that upon folding particularly the respective areas of the fabric piece adjacent the elastic bands are correctly superimposed. Conveniently, the above additional means can take the form of gripping fingers mounted on each side of the stretched fabric adapted to be moved above and to grip and stretch opposed elasticised portions of the fabric piece. In addition, the apparatus may also comprise a plurality of brushes mounted above the elastic bands of the fabric piece for vertical movement and horizontal movement along said elastic bands. The purpose of the brushes is to align the elastic bands with the free ends of the suction pipes to enable suction of the elastic bands within said pipes.

Conveniently, the platform and adjacent platforms serving the supply and removal of the limp fabric piece and folded garment, respectively, are of low friction material and the underside of said garment and limp fabric piece feeding plates are of high friction material to facilitate movement of said fabric piece and garment on the adjacent platform.

Conveniently, the various method steps are carried out by programmed electronic and sequential actuation of the various components of the apparatus.

The invention will now be described and illustrated with reference to a preferred embodiment depicted in the accompanying drawings wherein:

FIGS. 1 and 2 show an overall view of part of the method and apparatus according to the invention;

FIGS. 3 to 11 show the various method steps and portions of the relevant apparatus used to carry out these steps.

FIG. 14 shows another view of the suction unit shown in FIG. 13;

FIG. 15 shows one form of the garment gripper mechanism associated with the apparatus of the invention.

Figure 1:
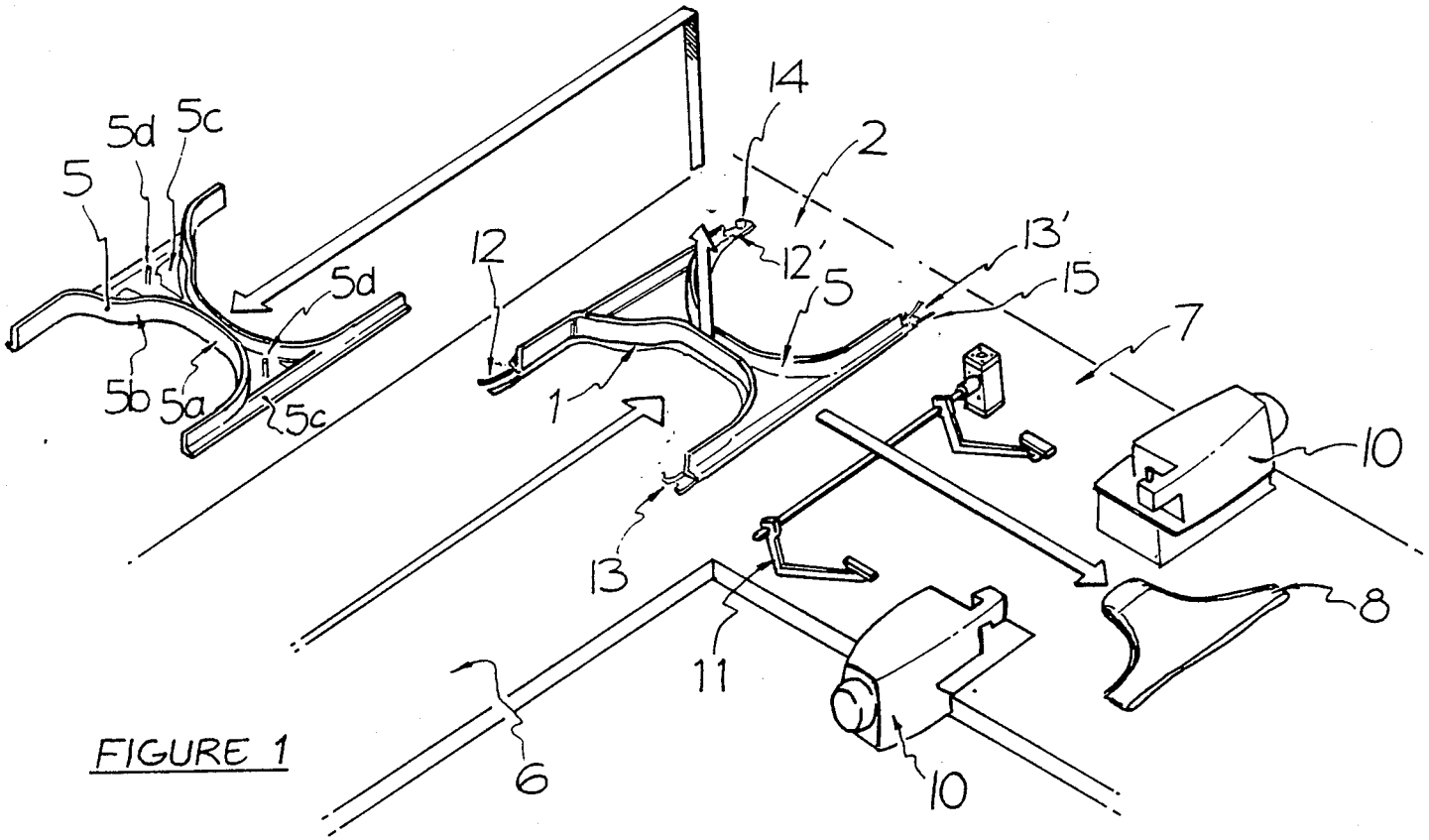

Referring to FIGS. 1 and 2, a limp fabric piece 1 (in the form of a blank for a brief) having four pairs of elastic bands 12, 12', 13, 13' extending therefrom is transported from a previous work-station, (not shown) to a platform 2 having a turning plate 3 such that one half (1*a*) of the fabric piece 1 is located on the turning plate 3, the axle 3*a* thereof extending through the crotch portion 1*b* of the brief. Turning plate 3 is pivotable by means of rotatably mounted cylinder 4. Stoppers 14,15 mounted on platform 2 are provided to stop a limp fabric piece feeder plate 5 at the correct position.

Platform 2 and adjacent platforms 6,7 (which may be integral therewith) are of low friction material whereas feeder plate 5 has a bottom surface of high friction material.

After the limp fabric piece 1 is stretched (described hereinbelow) feeder plate 5 is lifted therefrom and returned to an earlier work station (not shown). The fabric piece 1 is then folded by means of turning plate 3 to form a brief 8 which, after being held by garment pressing lever 11, is then moved by means of a garment feeding plate 9 to a pair of overlock sewing machines 10 for side seaming.

Referring to FIGS. 3 to 11, each pair of elastic bands 12, 12', 13, 13' has located adjacent to them, a corresponding pair of suction pipes 20 mounted on suction units (described hereinbelow, not shown). Each suction pipe 20 has at its outer end and located there within a pivotally mounted clip 21 pneumatically actuated for gripping (and releasing) the corresponding elastic bands (e.g. 13, 12') and releasing same. Each of adjacent elastic band pairs 12, 12' has furthermore associated with it a pair of opposed garment grippers 22 (described hereinbelow). The garment grippers 22 are actuated to move to a position above the fabric piece 1 in its stretched condition and to be raised or lowered in relation to the fabric piece 1. A plurality of stretcher fingers 70 may be brought into stretching engagement at selected positions on both sides of the fabric piece 1 associated with the stationary platform to properly align said piece before folding said turning plate 3 with the other half of said fabric piece 1 located on said plate 3.

Figure 3A:
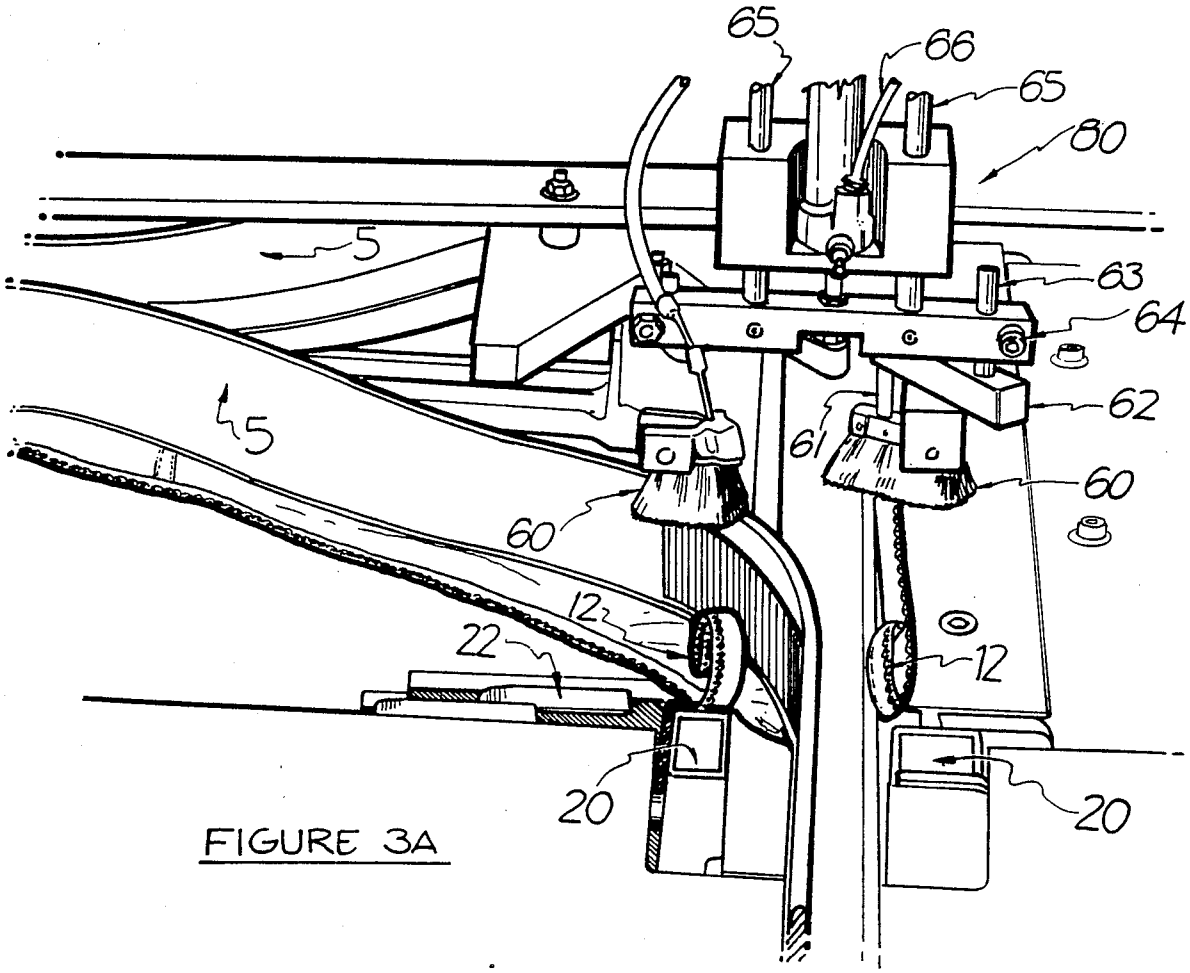
FIG. 3*a* is a more detailed view of a pair of the brushes mounted on their respective carriage.
Figure 3B:
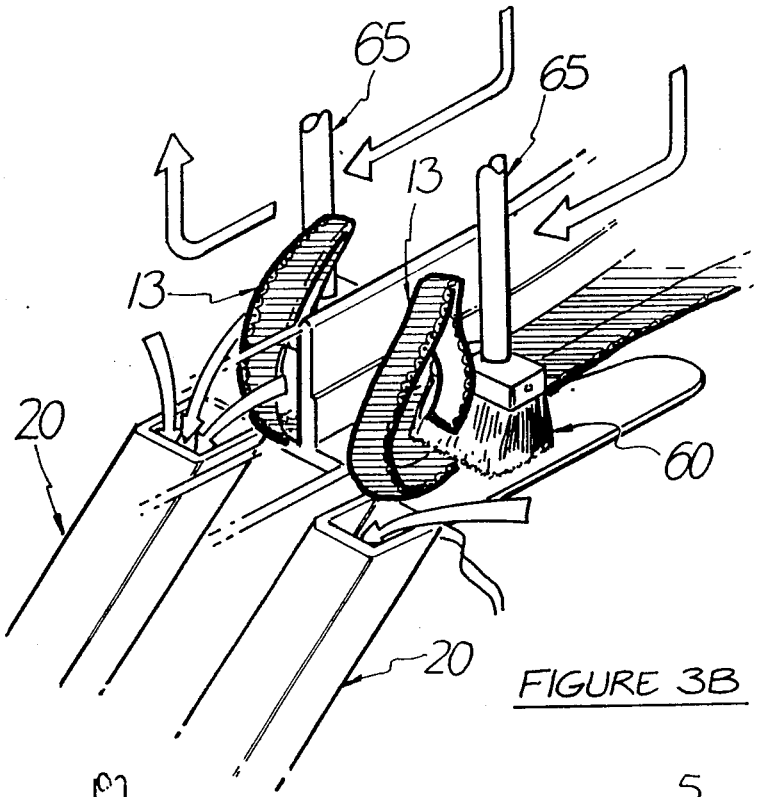
Figure 3C:
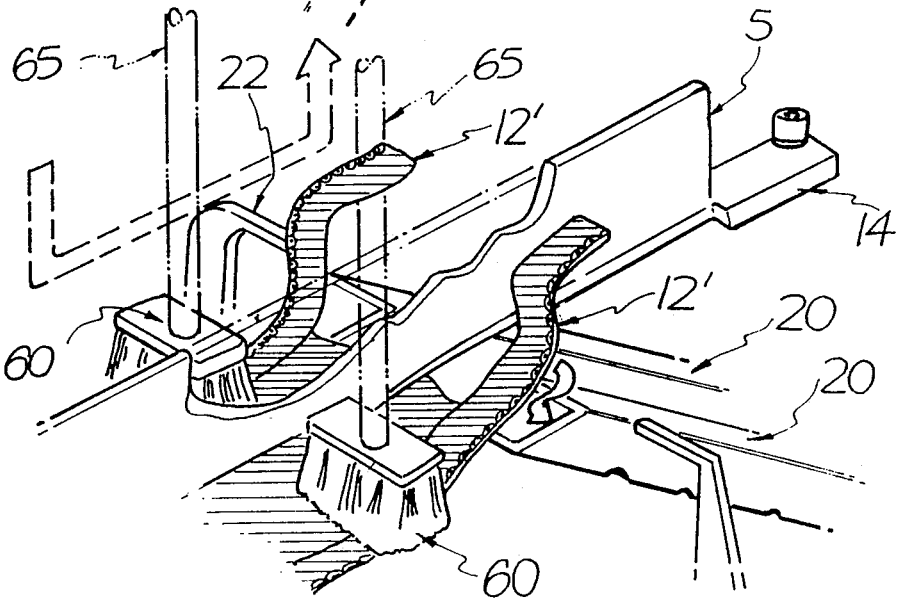
Figure 4A:
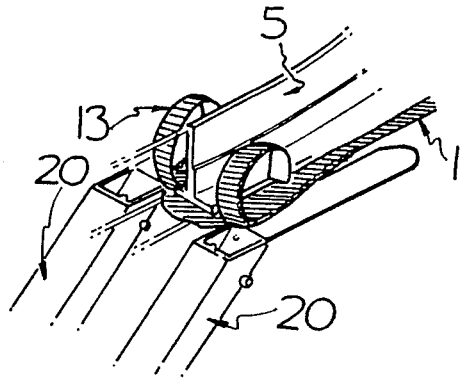
Figure 4B:
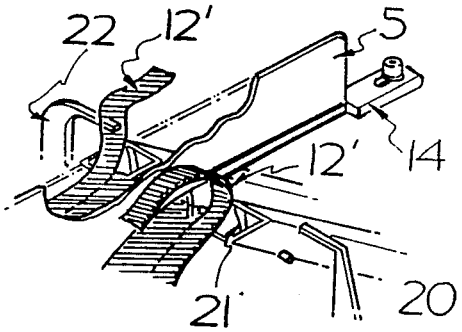
Figure 5A:
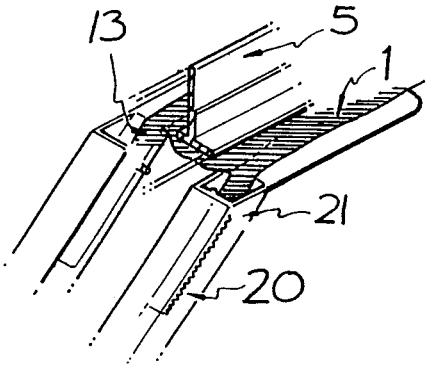
Figure 5B:
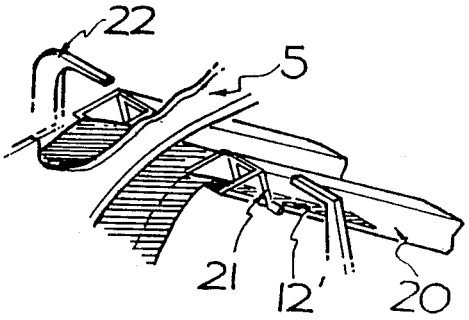
Figure 6A:
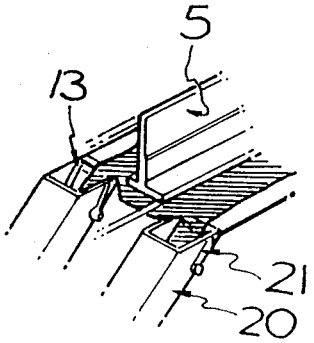
Figure 6B:
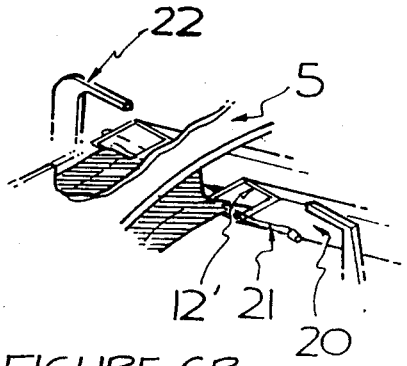

Referring specifically to FIGS. 3*a* to 3*c*, there are shown a pair of brushes 60 co-operating with a corresponding pair of elastic bands 13,12' sweeping the bands towards the open end of suction pipes 20. The brushes 60 depend by means of a rod assembly from a carriage 80, there being provided one such carriage 80 on each side of each half of the fabric piece 1. The brushes 60 are mounted on the carriages 80 for vertical and horizontal movement so that they are capable of being moved down onto and along the elastic band pairs 12,12',13 and 13' to sweep the bands into the respective suction pipes 20. Carriage 80 is mounted for horizontal movement on a rod (not shown) which also carries a second identical carriage (not shown) supporting the other pair of brushes (not shown) for co-operation with elastic bands 12 (not shown) and 12' (FIG. 3*a*). Brushes 60 are mounted via rods 61,62,63,64 and 65 on carriage 80, rods 65 being moveable in a vertical direction relative to carriage 80 to lower or raise brushes 60 relative to the elastic bands 12,12',13 and 13'. Actuation of carriage 80 (for horizontal movement) and rods 65 (for vertical movement) is by well-known pneumatic means (e.g. as shown at 66).

Figure 10:
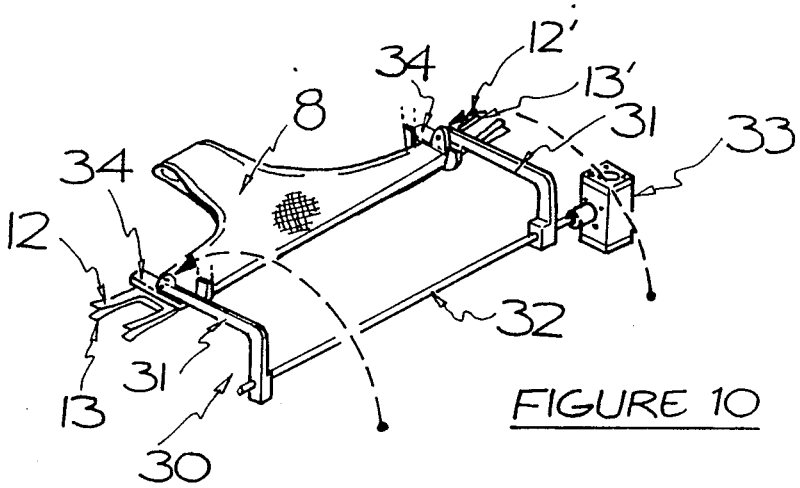

Specifically, with reference to FIG. 10, there is shown a garment pressing unit 30 which comprises a pair of garment pressing levers 31 mounted on a common axle 32 actuated for rotation by an electric motor 33. The ends of each lever are provided with a pivotally mounted platelet 34 which has the function, upon the garment pressing levers 31 being in the operative position, of aligning themselves with the folded fabric piece or garment 8.

Figure 11:
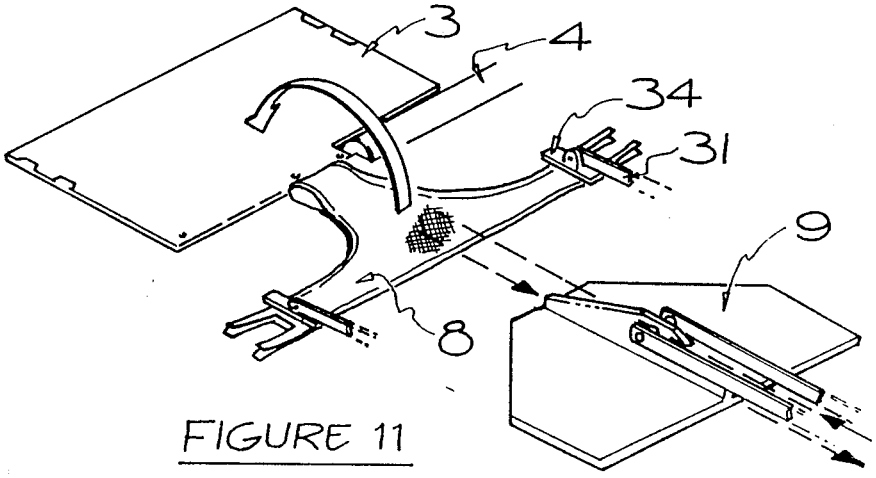

Referring to FIG. 11, a garment feeding plate 9 reciprocates between the position adopted by the folded fabric piece or garment 8 to a position adjacent the two overlock sewing machines 10 (see FIGS. 1 and 2). The plate has a lower contact surface of high friction material which is designed to frictionally hold the garment 8 when the garment is moved along the low friction platform 7.

The sequence of operations in relation to the limp fabric piece is as follows:

The fabric piece 1 is transported in an extended condition with the aid of the fabric piece feeding plate 5 to the location on platform 2 described herein before.

Vacuum is then applied by means of the air suction unit (described hereinbelow) and the air suction pipes 20 to the elastic bands 12, 12', 13, 13' whereby they are sucked into each of the pipes 20 with the aid of the brushes 60. The elastic bands 12, 12', 13, 13' are then gripped relative to the pipes 20 by means of the elastic band gripper clips 21 which are moved into the gripping position shown in FIGS. 5 and 6. The suction pipes 20 are then moved axially away from the platform 2 in order to stretch the fabric piece and the garment grippers 22 associated with elastic bands 12 and 12' are then actuated to move into engagement with the fabric piece 1 adjacent these elastic bands by moving the grippers 22 to a position above and then down upon the fabric piece 1 (cf. FIG. 8). Stretcher fingers 70 are then actuated to stretch and align the fabric piece 1 associated with the stationary platform with the other half of the fabric piece 1 to be folded.

Figure 9:
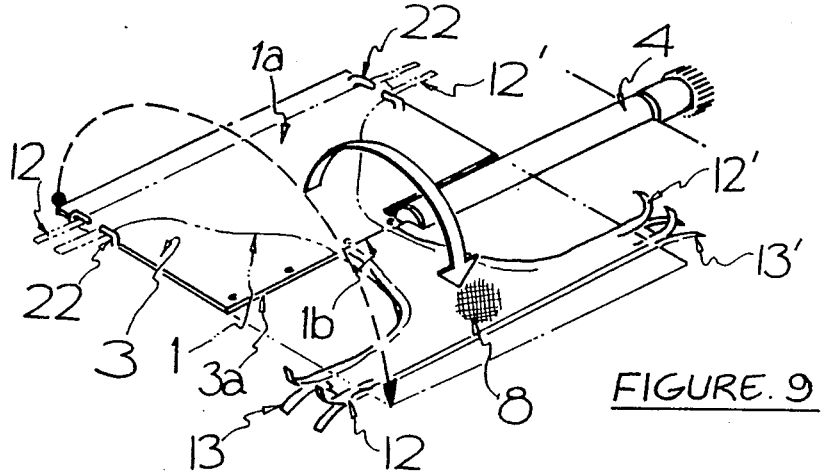

The turning plate 3 is then actuated by means of cylinder 4 such that it overlaps platform 2 with the two halves of the fabric piece 1 being superimposed and forming the garment 8 (cf. FIG. 9).

The garment pressing levers 31 are then actuated to engage the garment 8 on the inside of the garment grippers 22 whereafter the garment grippers 22, stretcher fingers 70 and the elastic band grippers 21 associated with elastic bands 13 and 13' are released (cf. FIG. 11). The turning plate 3 is then returned and the garment feeding plate 9 is moved and located above the garment 8 between the garment pressing levers 31(cf. FIG. 10). Levers 31 are then released and the garment is moved along platform 7 to a pair of overlock sewing machines 10 for seaming.

Figure 12:
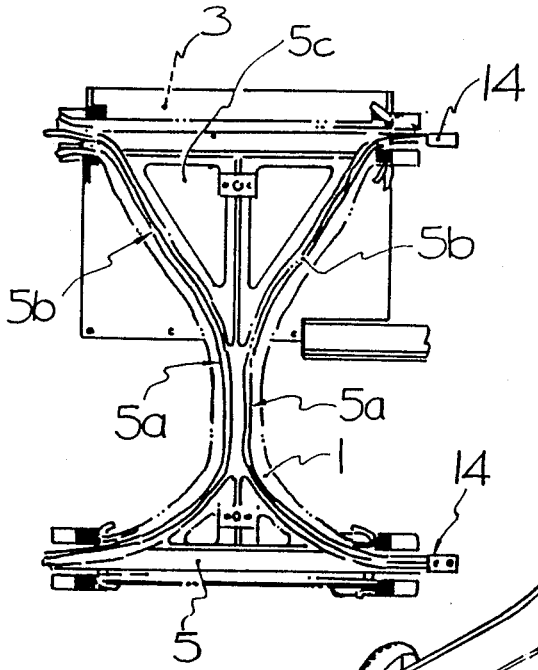
FIG. 12 shows a plan view of the limp fabric piece feeding plate partially located on the foldable segment of the platform.

Referring to FIG. 12, the fabric piece feeding plate 5 consists of a metallic plate having a configuration such that the fabric piece 1 protrudes beyond the edges **5*a* of the plate 5, the latter having opposed raised surfaces 5*b* for guiding a plurality of rollers concerned with a previous work-station (not shown) involved with the seaming of the corresponding opposed edges of the fabric piece 1. The plate 5 has a plurality of recesses 5*c* in order to minimise the weight thereof. The plate 5 also has a pair of opposed pins 5*d* which enable appropriate grippers to attach themselves to said pins 5*d* for lifting, lowering and moving said plate 5**.

Figure 13:
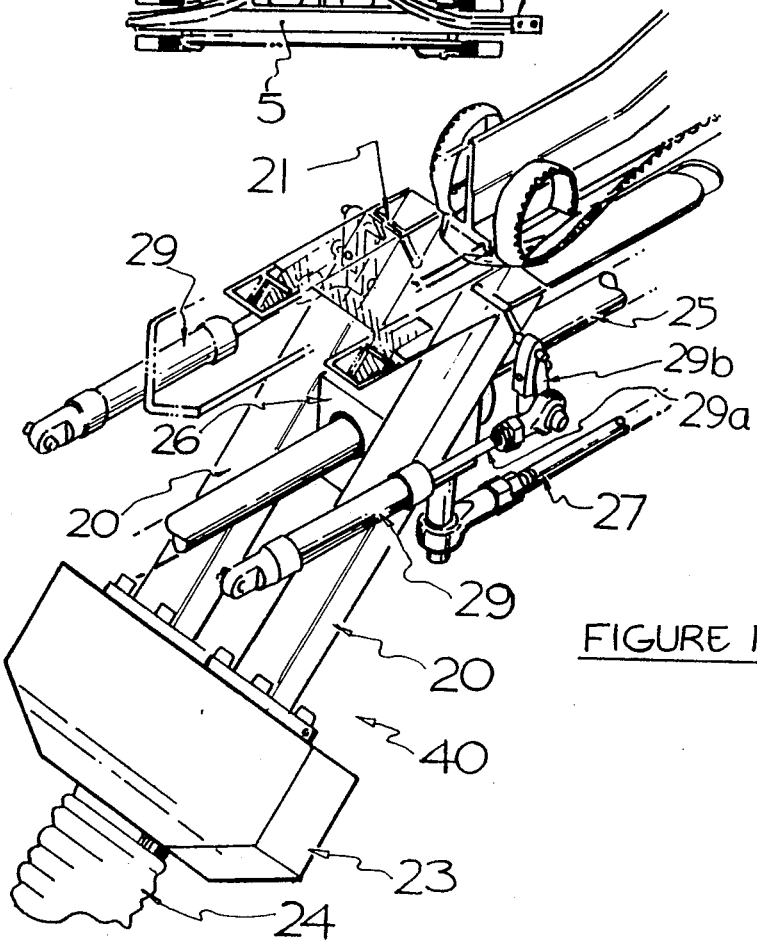
FIG. 13 shows one of the air suction and elastic band gripper units associated with the apparatus of the invention.

Referring to FIGS. 13 and 14, the air suction unit, generally indicated as 40, comprises a pair of air suction pipes 20 connected to a suction source (not shown) by means of manifold 23 and hose 24. The air suction unit 40 is mounted on a rod 25 extending through a collar 26 to which the air suction pipes 20 are attached. The air suction unit 40 is slidable along rods 25 for horizontal movement relative to the platform 2, such movement being actuated by a piston 27 connected to air cylinder 28.

An elastic band gripper in the form of a rectangular clip 21 is pivotally mounted on the inside of each pipe 20, pivotal movement of the clip 21 being actuated by air cylinder 29 and piston **29*a* connected to said clip 21 through a link 29*b***.

Referring to FIG. 15, a pair of opposed garment grippers 22 are slidably mounted on rod 50 and are pivotally connected by a pair of arms 51 to a pin 52 attached to piston block 53 mounted on piston 54 associated with air cylinder 55. Pin 52 moves within a slot 56 in a plate 57 one end 58 of which has piston 54 extending therethrough. This enables sliding movement of the garment grippers 22 on rod 50 consequent upon vertical movement of the pin 52 actuated by air-cylinder 55 and piston 54.

Rod 50 is supported by collar 59 to which is attached the other end of plate 57 which in turn is attached to a further collar 61, these being rigidly secured together to allow vertical movement of collar 61 on upright post 62 extending therethrough actuated by piston 63 and associated air cylinder 64. This enables vertical movement of the garment grippers 22 relative to the platform 2.

Figure 16A:
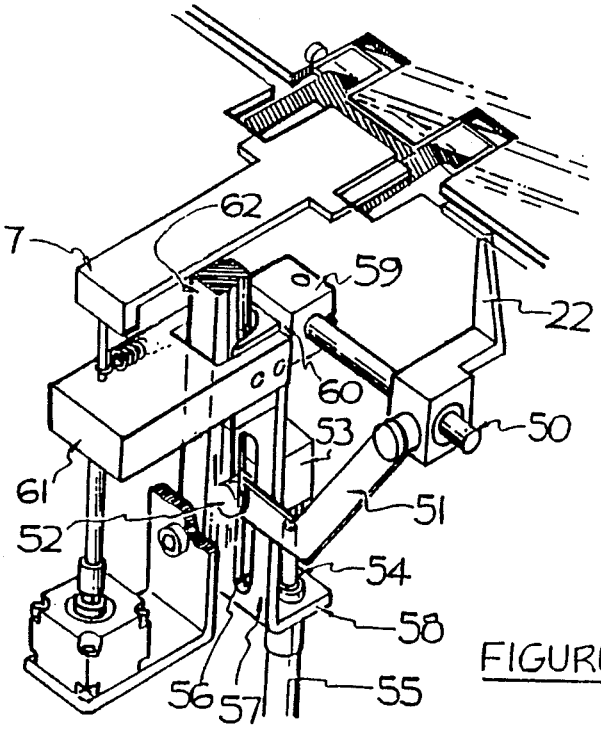
FIGS. 16A, 16B and 16C show another, preferred form of the garment gripper mechanism and associated optical sensing mechanism.

Referring to FIG. 16A, there is shown the mechanism shown in FIG. 15 but modified to actuate only one garment gripper 22 to co-operate with only one elastic band, i.e. the waist band.

Figure 16C:
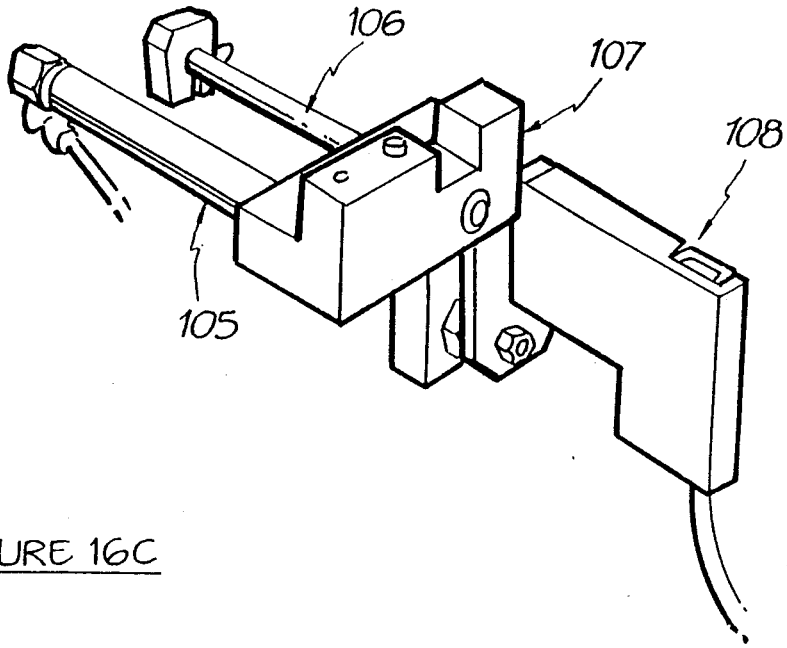
Figure 16B:
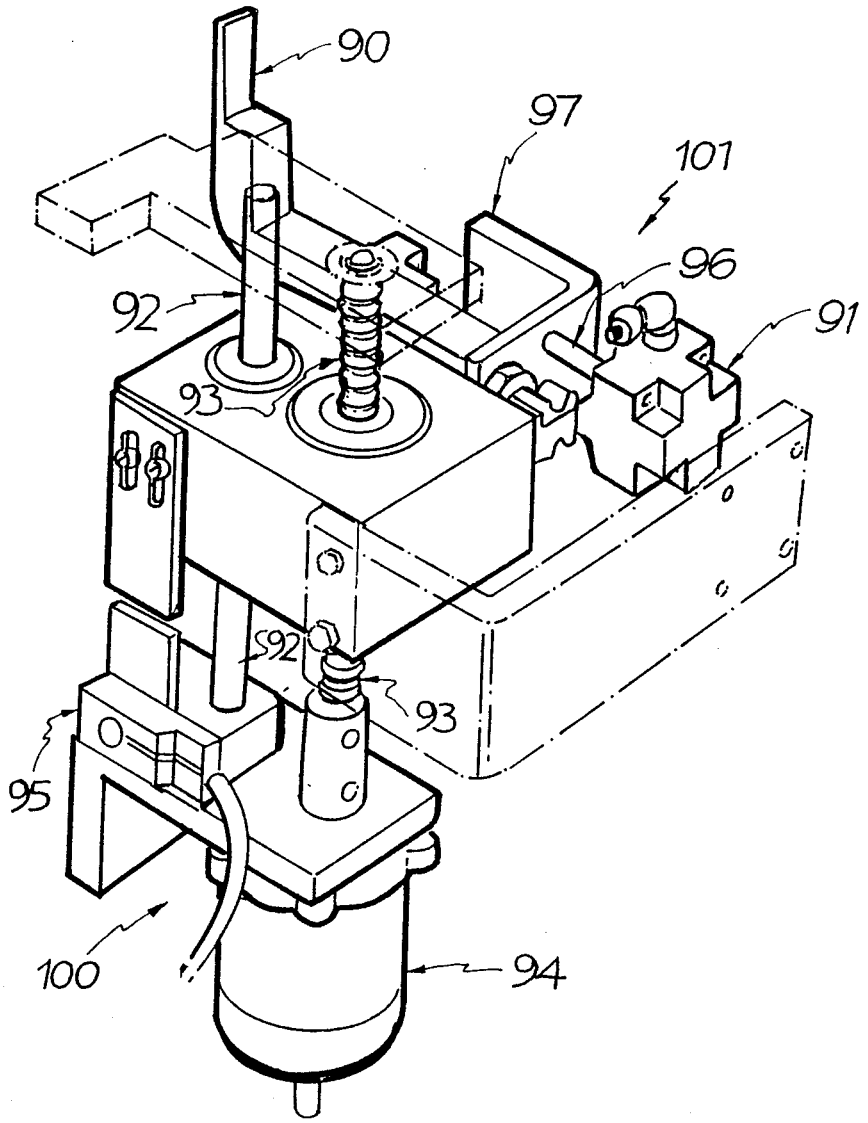

Referring to FIG. 16B, there is shown another garment gripper mechanism (unit) for co-operation with the other elastic band, i.e. the leg band. The unit is comprised of two main activating sub-assemblies, viz, a pulse motor sub-assembly (generally indicated as 100) to effect horizontal movement of the overall unit including the garment gripper 90, and a garment gripper positioning and clamping sub-assembly (generally indicated as 101) for effecting vertical movement of garment gripper 90 via pneumatic means.

Sub-assembly 100 comprises essentially a pulse motor 94, controlled by switch 95, which actuates a driven threaded shaft 93 to move the whole unit (including gripper 90) horizontally along carrier slider shaft 92 to a selected position over the leg elastic band (not shown).

Sub-assembly 101 comprises essentially air cylinder 91 which by means of piston rod 96 and bracket 97 actuates garment gripper 90 for vertical movement over the leg elastic band to clamp said band in the selected position.

Referring to FIG. 16C, there is shown an optical sensing mechanism (of which several are used in connection with the unit shown in FIG. 16B). The mechanism (unit) comprises a fibre optic sensor 108 mounted of a carrier block 107 driven by air cylinder 105 and slidably mounted on shaft 106.

The movement of both sub-assemblies 100 and 101 is co-ordinated by signals from a central processing unit (not shown) which obtains its data from the optical sensing mechanism shown in FIG. 16C.

The units shown in FIGS. 16B and 16C are located in separate locations. The unit shown in FIG. 16B is mounted on the lower side of turning plate 3 while the optical sensing unit shown in FIG. 16C is fixed in position to the main frame of the overall machine. Co-ordination between these two units ensures that the alignment of the elastic leg bands of the garment is as is required to enable accurate sewing of the side seams thus guaranteeing ideal assembly appearance of the finished garment.

We claim:

1. A method of stretching and folding a limp fabric piece having a plurality of opposed elastic bands extending therefrom comprising locating and holding said fabric piece in an extended condition on a platform having a foldable segment such that one half of said fabric piece is located on said foldable segment and in a position to enable subsequent folding of fabric piece to obtain the shape of the desired garment, applying suction to said elastic bands in an axial direction thereto by suction means, gripping said elastic bands relative to the suction means, releasing the suction, stretching said fabric piece by axially moving the suction means with the gripped elastic bands away from said fabric piece, gripping the fabric piece adjacent the elastic bands, associated with said foldable segment, relative to the segment in the correct position to form the garment with overlapping elastic bands when folded, releasing the gripping hold on said elastic bands associated with said foldable segment, folding said segment to form said garment with said elastic bands overlapping, pressing and holding said garment adjacent said overlapping elastic bands, releasing the grip on the elastic bands associated with said platform and said foldable segment respectively, and returning said foldable segment.

2. A method as claimed in claim 1 for the further purpose of transporting said folded garment to a sewing station, further comprising holding said folded garment flat on the platform in the area between said overlapping elastic bands, releasing the hold on said garment adjacent said overlapping elastic band, and moving said folded garment along an adjacent platform to a sewing station.

3. Apparatus for stretching and folding a limp fabric piece having a plurality of opposed elastic bands extending therefrom comprising a platform having a foldable segment, means for folding said foldable segment relative to the platform, a limp fabric piece feeding plate for feeding said limp fabric piece to said platform and holding said fabric piece thereon in an extended condition and in a pre-determined position to enable eventual folding of the fabric piece to produce a garment, means for moving said plate member horizontally or vertically, suction means located adjacent said platform for applying suction to the elastic bands extending from the fabric piece, elastic band gripper means associated with the suction means for gripping and holding the sucked-in elastic bands, relative to said suction means, means for moving said suction means relative to said platform to stretch said fabric piece, garment gripper means associated with said foldable segment for gripping and holding the stretched fabric piece at the correct position for folding said piece and garment pressing means associated with said platform for pressing and holding the folded garment adjacent the overlapping elastic bands of said fabric piece.

4. Apparatus as claimed in claim 3 wherein the suction means comprises a plurality of suction pipes, one adjacent each elastic band, connected to an air-suction source and being moveable relative to said platform so as to stretch the fabric piece.

5. Apparatus as claimed in claim 3 wherein the elastic band gripper means consists of a clip pivotally mounted within the outer end of the suction pipes.

6. Apparatus as claimed in claim 3 wherein the garment gripper means consists of a pair of horizontally, slidably mounted bracket reciprocably moveable to opposed positions above the fabric piece adjacent each pair of elastic bands and being also mounted for vertical movement to achieve gripping and release respectively of the fabric piece relative to the foldable segment.

7. Apparatus as claimed in claim 6 wherein said garment gripper means associated with each leg elastic band is mounted separately to the other gripper means and is controlled by optical sensing means to ensure alignment of the leg elastic bands to ensure in turn alignment of these bands after folding.

8. Apparatus as claimed in claim 3 wherein said garment pressing means consists of a pair of arms pivotally mounted on a common axle, the brackets being spaced such that contact with the garment is made adjacent but on the outside of the point of contact of the fabric gripper means.

9. Apparatus as claimed in claim 8 wherein said arms have pivotally mounted at the outer ends thereof garment contacting platelets for contacting and holding the folded garment against the platform.

10. Apparatus as claimed in claim 3 comprising a plurality of additional gripping fingers located and operating on both sides of the stretched fabric piece laterally thereof so as to stretch the fabric piece in a lateral direction prior to folding to ensure correct alignment thereof.

11. Apparatus as claimed in claim 3 comprising in addition a pair of brushes mounted for vertical and horizontal movement above each pair of elastic bands, the horizontal movement sweeping the elastic bands towards the suction pipes.

12. Apparatus as claimed in claim 3 further comprising a garment feeding plate reciprocating horizontally adapted to be superimposed on the garment between the points of contact of said garment pressing means and moving said garment to a sewing station after release of said garment pressing means.

* * * * *